United States Patent [19]

Pachmayr et al.

[11] 4,328,633

[45] May 11, 1982

[54] GUN WITH CUSHIONED FOREND

[75] Inventors: Frank A. Pachmayr, Los Angeles; Jack R. Farrar, Whittier, both of Calif.

[73] Assignee: Pachmayr Gun Works, Inc., Los Angeles, Calif.

[21] Appl. No.: 151,138

[22] Filed: May 19, 1980

[51] Int. Cl.[3] ..... F41C 23/00

[52] U.S. Cl. ..... 42/74; 42/71 R; 42/71 P

[58] Field of Search ..... 42/74, 71 R, 71 P, 72, 42/75 A, 75 D

[56] References Cited

U.S. PATENT DOCUMENTS

| | | | |
|---|---|---|---|
| 2,104,129 | 1/1938 | Kress | 42/74 |
| 3,041,768 | 7/1962 | Brooks, Jr. | 42/71 R |
| 3,672,084 | 6/1972 | Pachmayr | 42/71 P |
| 3,815,270 | 6/1974 | Pachmayr | 42/71 P |
| 4,043,066 | 8/1977 | Pachmayr et al. | 42/71 P |
| 4,132,024 | 1/1979 | Pachmayr et al. | 42/71 P |
| 4,148,149 | 4/1979 | Pachmayr et al. | 42/71 P |
| 4,162,586 | 7/1979 | Pachmayr | 42/71 P |

OTHER PUBLICATIONS

Thompson/Center Arms Catalog No. 5 pp. 2–11.

*Primary Examiner*—Charles T. Jordan
*Attorney, Agent, or Firm*—William P. Green

[57] ABSTRACT

A gun having a forend at the underside of the barrel including a body of elastomeric material with outer surfaces deformable to cushion a user's contact therewith and preferably containing a reinforcing material stiffer than the elastomeric material desirably taking the form of a U-shaped reinforcing element which is clamped and retained between a fastener and the barrel of the gun to secure the forend to the barrel.

12 Claims, 8 Drawing Figures

GUN WITH CUSHIONED FOREND

BACKGROUND OF THE INVENTION

This invention relates to improved guns, and particularly to improved 'forend' or fore arm structures for a gun.

Certain pistols and other guns have at the underside of the barrel of the gun an element referred to as a 'forend', which may under some circumstances be held by a user's hand during firing, or otherwise be contacted to support and aim the gun. These forend elements are normally formed of wood, and may be secured to the barrel by a fastener or fasteners extending upwardly through the forend and connecting threadedly into a socket or sockets formed at the underside of the barrel. The upper portion of the forend may be shaped to contact and fit a lower portion of the barrel.

SUMMARY OF THE INVENTION

A forend structure formed in accordance with the present invention includes a body of elastomeric material, preferably neoprene rubber, which is detachably connected to and extends along the underside of the barrel, and which presents outer surfaces deformable in a manner cushioning the contact of a user's hand or other supporting means with the forend. The result is a more effective supporting action, and an improved gripping or holding effect when the forend is employed as a means of aiming the gun.

The forend unit desirably also includes reinforcing material embedded in and bonded to the elastomeric material, and which is stiffer than the elastomeric material to give the overall forend unit strength and a shape holding character without detracting from the cushioning effect of the outer deformable surfaces of the elastomeric body. The reinforcing material is preferably formed of essentially rigid sheet metal or the like, desirably apertured to allow extension of some of the rubber material through the apertures and between opposite sides of the sheet material to enhance the bond between the parts. The assembly may be so constructed as to permit the reinforcing material to be essentially clamped between a fastener and the barrel, in a manner holding the reinforcing material essentially rigidly in fixed position relative to the barrel while permitting the discussed deformation of the elastomeric material. The reinforcing element may be shaped to an essentially U-shaped vertical sectional configuration, having a bottom wall against which the fastener or fasteners exert upward force, and having two side walls projecting upwardly toward and applying upward clamping force to the underside of the barrel. The rear portion of the device may include rearward extensions of the side walls which are spaced slightly farther apart than are the forward portions of the side walls and which are received at opposite sides of the frame of the gun. The forend may contain a recess at the underside of the gun barrel defined at its bottom and opposite sides by the mentioned U-shaped reinforcing part. This recess may contain a connector element, which is secured by first fastener means to the barrel, with second fastener means then securing the forend assembly to that member.

BRIEF DESCRIPTION OF THE DRAWINGS

The above and other features and objects of the invention will be better understood from the following detailed description of the typical embodiments illustrated in the accompanying drawings, in which.

DESCRIPTION OF THE PREFERRED EMBODIMENTS

Figure 1:
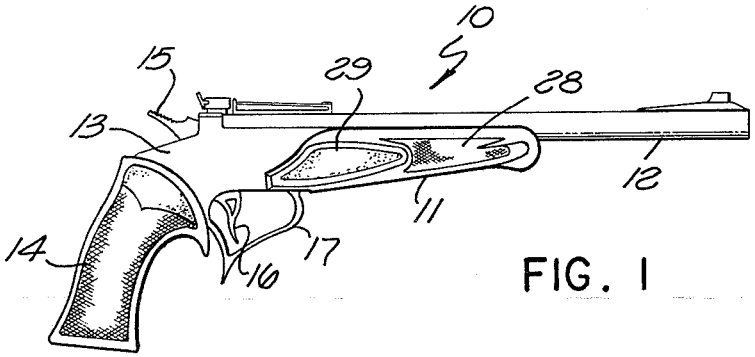
FIG. 1 is a side view of a gun having a forend unit constructed in accordance with the invention.

The gun 10 illustrated in FIG. 1 and shown fragmentarily in some of the other views is of a known type except for the provision of a cushioning forend or fore arm unit 11 on the gun at the underside of barrel 12 in lieu of the usual rigid forend or fore arm formed of wood. The gun includes a frame 13 to which barrel 12 is mounted in a forwardly projecting position, with a handle or grip structure 14 projecting downwardly from frame 13 for holding the gun as a pistol. The hammer 15 for firing a cartridge within the barrel is under the control of a trigger 16 enclosed within a trigger loop 17 carried by the frame.

Figure 6:
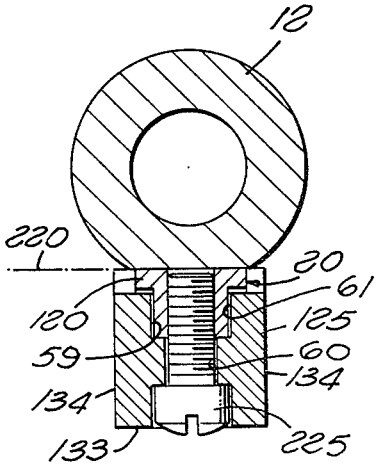
FIGS. 6 and 7 are vertical sections taken on lines 6—6 and 7—7 respectively of FIG. 4.

Barrel 12 is illustrated as having an outer cylindrical surface 18, centered about the axis 19 of the barrel, though it is to be understood that the invention may also be adapted for use in conjunction with barrels which are externally octagonal in transverse cross-section, or of other non-circular external cross-section. At its underside, the barrel 12 carries two downwardly projecting lugs or nut elements 20 and 21, forming sockets containing internal downwardly opening or facing threaded bores 22 centered about vertical axes 23 and 24. When a conventional wooden forend is employed on the gun, it is secured to the underside of the barrel by a pair of screws extending upwardly through the wooden forend and connecting it to the two sockets 20 and 21. The cushioning forend 11 of the present invention is secured by a single such screw 25 attached to a connector element 125 which in turn is secured to the barrel by two screws 225 connected into the two threaded sockets 20 and 21. It is contemplated that sockets 20 and 21 may, if desired, be formed integrally with the barrel, but preferably are formed as separate elements suitably connected to the barrel in a relation retaining the sockets against movement downwardly relative thereto. Desirably, the connection is made by providing the sockets with upper enlarged portions 120 (FIGS. 4 and 6) of dovetail section slidably insertable horizontally and transversely of the barrel (along axis 220 of FIG. 6) into and out of mating horizontal dovetail grooves 320 formed in the underside of the barrel. The sockets may be a forced fit within those dovetail grooves to be frictionally retained therein.

The cushioned forend unit 11 includes a body of elastomeric material 26 and a reinforcing element 27 which is formed of a material stiffer than the elastomeric body 26 and is embedded therein and bonded thereto. The material of elastomeric body 26 may be rubber, preferably neoprene rubber, of a composition enabling the body 26 to deform fairly readily when gripped or otherwise contacted in use, and to resiliently return to the illustrated normal condition when the deforming force is removed. Desirably, the elastomeric material has a Shore hardness between about 33 and 45 on the A scale. The outer surfaces of the elastomeric body may be irregularized to facilitate gripping and for appearance, typically by checkering in an area 28 at each side of the device and slight roughening of an area 29 at each side.

Figure 7:
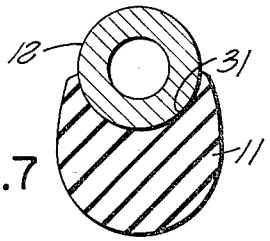

At its upper side, the elastomeric body 26 is shaped to define an upwardly facing recess or groove 30 (FIGS. 3 and 7) adapted to receive and contact the lower portion of the barrel, to locate the forend relative thereto. For this purpose, recess 30 is defined by a cylindrically curving surface 31, centered about axis 19 of the barrel, and having a radius of curvature corresponding to the outer surface 18 of the barrel. When screw 25 is tightened upwardly it brings surface 31 of elastomeric body 26 into tight contact with the outer surface 18 of the barrel as seen in FIGS. 3 and 7.

The cylindrical barrel contacting surface 31 of the elastomeric body is interrupted at the location of a second recess 32 formed in body 26 and extending downwardly beneath the barrel and containing connector element 125. This recess 32 is of rectangular configuration, as seen in FIGS. 3 and 4, being defined by a horizontal upwardly facing bottom wall surface 33, two parallel vertical opposite side wall surfaces 34 lying in planes parallel to axis 19, and two parallel vertical opposite end surfaces 35 and 36 (FIG. 4) lying in planes perpendicular to axis 19. Screw 25 extends upwardly through this recess 32. Forwardly and rearwardly of recess 32, the cylindrical surface 31 continues entirely across the underside of the barrel, as seen in FIG. 7.

The reinforcing element 27, which as previously indicated is substantially stiffer than the material of elastomeric body 26, is preferably substantially rigid and capable of maintaining the illustrated configuration under any distorting force which may be encountered in use of the device. In most instances, it is preferred that reinforcing element 27 be formed of rigid sheet metal, desirably steel, and be embedded within and bonded to the material of body 26 at the time of molding and curing of that body.

Figure 3:
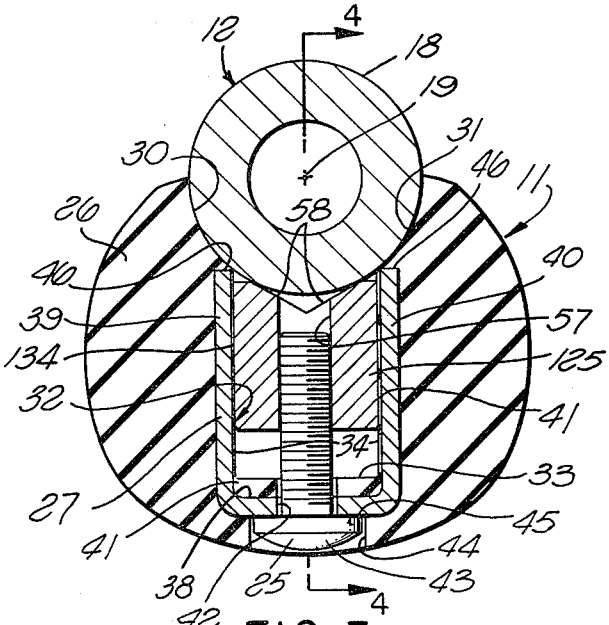
FIG. 3 is an enlarged transverse vertical section taken on line 3—3 of FIG. 2.
Figure 4:
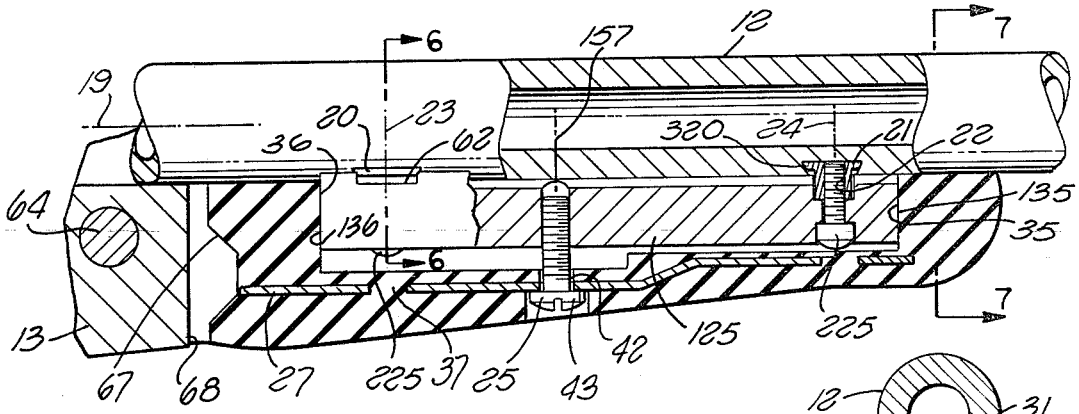
FIG. 4 is an axial vertical section taken on line 4—4 of FIG. 3.

Throughout most of its length in a front to rear direction (parallel to axis 19), reinforcing element 27 is of a generally U-shaped cross-section transversely of axis 19, as seen best in FIG. 3. This U-shaped cross-section is defined by a bottom wall 38 of part 27, and two upwardly projecting parallel opposite side walls 39 and 40. These walls 38, 39 and 40 essentially define the bottom and opposite sides of the generally rectangular recess 32, but with a thin layer 41 of the elastomeric material which forms body 26 extending along the upper surface of bottom wall 38 and the inner surfaces of side walls 39 and 40, so that the metal of part 27 is preferably not exposed but rather is coated within the recess. It is therefore this thin layer of rubber at the inside of part 27 which forms the previously mentioned bottom and side wall surfaces 33 and 34 of recess 32. To enhance the bond between rubber body 26 and reinforcing element 27, the sheet metal of part 27 contains apertures 37 distributed over its bottom and side walls 38, 39 and 40 so that some of the rubber or other elastomeric material may extend into these apertures at the time of molding and be retained therein.

Screw 25 extends upwardly through a central bottom opening 42 formed in the bottom wall 38 of reinforcing part 27. The enlarged head 43 of screw 25 is of a diameter greater than that of opening 42, so that the head when tightened upwardly can apply upward force to bottom wall 38 to clamp the forend unit upwardly against barrel 12. An opening 44 extending through the elastomeric material of body 26 at the location of opening 42 receives head 43, with a thin layer 45 of the elastomeric material of body 26 being provided at the underside of wall 38 and about opening 42 so that the head does not initially directly contact wall 33 but rather applies upward force to wall 38 through layer 45.

The upper edges 46 of side walls 39 and 40 of reinforcing part 27 are adapted to engage upwardly against the underside of barrel 12 when the forend is in its assembled position of FIG. 3. These edges 46 are initially located in close proximity to the cylindrically curving upper surface 31 of body 26, but are preferably covered with a very thin layer of the elastomeric material of body 26. When the device is clamped upwardly against barrel 12, edges 46 cut through the thin layer of rubber covering their upper ends to directly contact barrel 12, or alternatively may apply their upward clamping force to the barrel through that thin layer of rubber.

Figure 2:
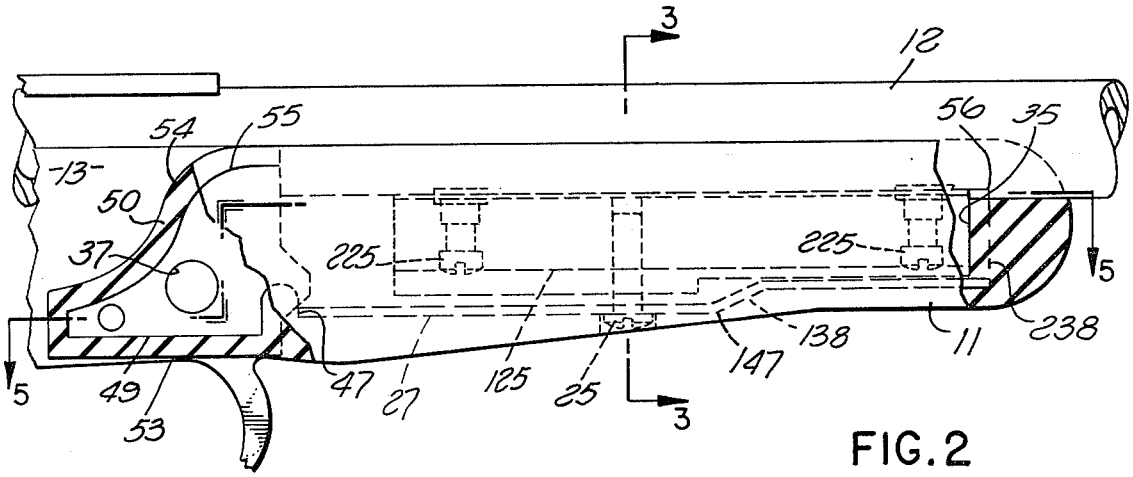
FIG. 2 is an enlarged fragmentary side view, partially broken away, showing the forend of FIG. 1.

Part 27 may have the cross-sectional configuration illustrated in FIG. 3 from the location 47 of FIG. 2 forwardly to the location 147 of that figure. In this region between the locations 47 and 147 the bottom wall 38 extends directly horizontally when axis 19 of the barrel is horizontal. Forwardly of the location 147, the bottom wall 38 may rise relatively abruptly upwardly at 138 and then extend directly horizontally at an elevation higher than the rear portion of the bottom wall, to the forward end 238 of the reinforcing part. The forward extremity of part 27 may project beyond the transverse forward end wall 35 of recess 32, to be very effectively embedded within the forward portion of the elastomeric body. Similarly, the rear portion of reinforcing part 27 may project rearwardly beyond wall 36 of the recess to be completely embedded within the rubber of body 26 rearwardly beyond that wall 36.

Figure 5:
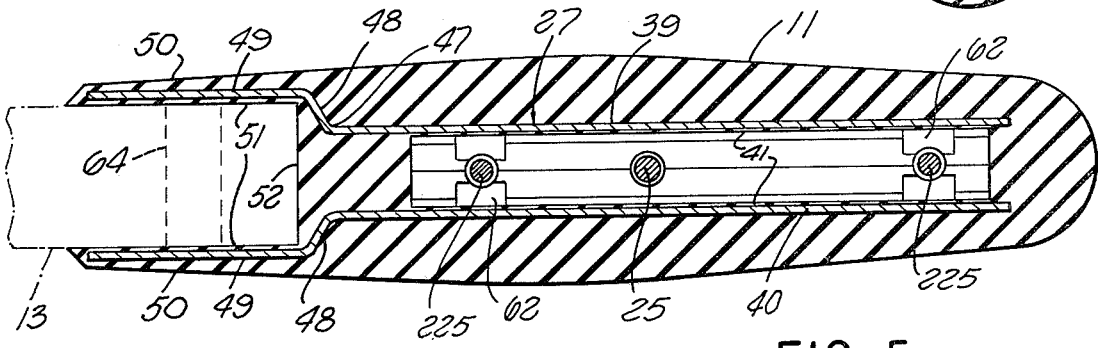
FIG. 5 is a horizontal section taken on line 5—5 of FIG. 2.

Referring now to FIG. 5, as the two side walls 39 and 40 of reinforcing part 27 extend rearwardly beyond the location 47, the two sidewalls are bent laterally outwardly and away from one another at 48, to form rear sidewall portions 49 of part 27 extending parallel to one another and vertically in planes disposed at opposite sides of and equidistant from axis 19 of the barrel. These rear portions 49 are embedded within rearwardly projecting portions 50 of the elastomeric body 26. The inner parallel surfaces 51 of the rearwardly projecting portions 50 of the elastomeric body define with a transverse surface 52 a recess which receives a portion of the frame 13 of the gun. Thus, two portions 50 of the elastomeric body and their contained reinforcing element portions 49 are received at opposite sides of the frame essentially above the trigger location. As seen from the side of forend unit 11 (FIG. 2), the rear portions 50 and their contained portions 49 of the reinforcing element may be of progressively decreasing height as they advance rearwardly, having essentially horizontal bottom edges 53 and upper edges 54 which curve downwardly as they advance rearwardly.

The connector element 125 may be a rigid generally rectangular block, and is typically formed of an appropriate metal such as steel or aluminum. This element may have a rectangular horizontal cross sectional configuration corresponding to that of recess 32 in part 26, to occupy the entire horizontal extent of the recess and be a close fit therein in a manner effectively transmitting horizontal forces, including recoil forces, between part 125 and body 26. More particularly, part 125 may have parallel vertical transverse end faces 135 and 136 simultaneously engaging end walls 35 and 36 of recess 32, and similarly may have parallel vertical axially extending side surfaces 134 simultaneously engaging side walls 34 of recess 32. The horizontal undersurface 133 of part 125 may be spaced a short distance above the bottom wall 33 of recess 32.

Connector element 125 has a longitudinally central threaded bore 57 into which screw 25 is threadedly connectable along a vertical axis 157. The upper surface 58 of element 125 forms a typically V-shaped axially extending recess 58 which receives a lower portion of the barrel and engages it along spaced parallel areas of essentially line contact in a manner effectively locking element 125 in a rigidly fixed position of extension along the underside of the barrel when screws 225 are connected upwardly through vertical passages 59 in element 125 into threaded sockets 20 and 21. Passages 59 may have lower cylindrical portions 60 which are centered about the vertical axes of sockets 20 and 21 and within which the shanks of screws 225 are fairly close fits, and upper larger diameter cylindrical portions 61 centered about the axes of sockets 20 and 21 and containing those sockets in closely fitting relation. Along its opposite side edges, element 125 is shaped to form at the location of each of the sockets 20 and 21, a pair of essentially rectangular recesses or notches 62 (FIGS. 4 and 5) which receive in closely fitting relation the lateral extremities of dovetail heads 120 of elements 20 and 21 in an interfitting relation further assuring proper positioning of element 125 relative to the barrel.

In placing the device of FIGS. 1 to 7 in use, a person first detaches the conventional rigid wooden forend from the gun, and then positions the connecting element 125 beneath the barrel at essentially the location illustrated in FIGS. 2 through 6. Element 125 is secured rigidly to the barrel by screws 225, and screw 25 is inserted upwardly through the bottom openings 44 and 42 in forend 11, and connected into element 125. As screw 25 is tightened in element 125, head 43 exerts upward force against the reinforcing part 27 to clamp it upwardly against the barrel, and effectively confine or clamp part 27 tightly between head 43 and the barrel in rigidly fixed position relative thereto. Edges 46 at the top of part 27 have straight line contact with the underside of the barrel for the entire distance between the locations 55 and 56 of FIG. 2, to very tightly lock the forend in position. The elastomeric material of body 26 is not, however, confined or clamped as tightly between any retaining parts, and is free for substantial deformation when gripped by a user or contacted by a supporting element or other part, to enhance the manner in which the gun may be held or supported. In most instances, tightening of the screw will bring head 43 into direct metal to metal contact with bottom wall 38 of the reinforcing part, and will bring edges 46 into tight metal to metal contact with the barrel.

The gun is adapted to be broken open in conventional manner by pivoting the barrel about a pivot pin 64 (FIG. 4) relative to frame 13 in a manner swinging the forward end of the barrel downwardly to expose the rear end of the barrel. The cushioned forend 11 embodying the present invention does not interfere with such swinging movement of the barrel relative to the frame. As the barrel swings downwardly, the forend swings with it, with the rear portions 50 of the forend received at opposite sides of a portion of frame 13 and pivot pin 64 but being free to turn relative thereto. As seen in FIG. 4, the rear surface 52 of elastomeric body 26 preferably contains a rearwardly facing or opening recess or groove 67, which has the cross-section illustrated in FIG. 4 across the entire transverse width of frame 13, and which is shaped to receive the forward corner portion 68 of gun frame 13 when the barrel and unit 11 pivot downwardly, to thus avoid interference by unit 11 with such pivotal movement.

Figure 8:
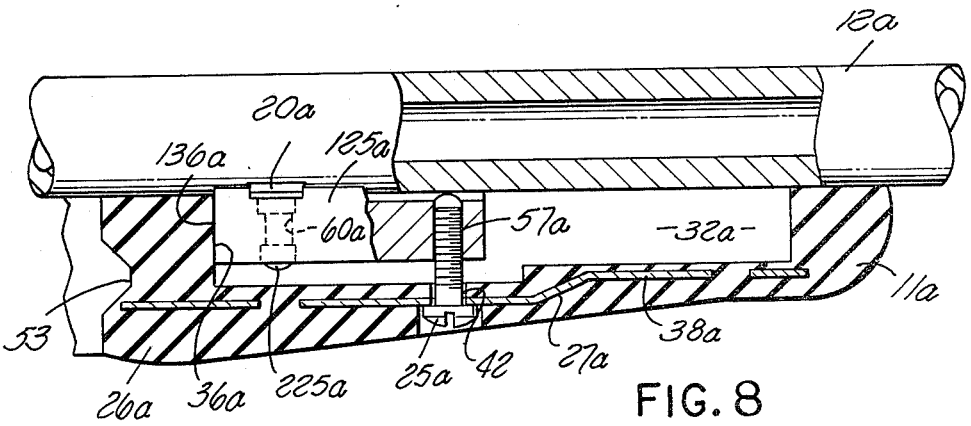
FIG. 8 is a vertical axial sectional view similar to FIG. 4, but showing a variational arrangement.

FIG. 8 shows fragmentarily a variational arrangement in which a forend unit **11*a* identical with the unit 11 of FIGS. 1 to 7 is attached to a gun having a barrel 12*a* which may be shorter than that shown in FIG. 1 and has only a single fastener receiving internally threaded socket 20*a* at its underside rather than the two sockets 20 and 21 of FIG. 4. The connector element 125*a* of FIG. 8 is shorter than block 125 of the first form of the invention, and has only one passage 60*a* for receiving the single socket 20*a* and a coacting screw 225*a* securing element 125*a* to the barrel, but is otherwise identical to element 125*a*. The fastener 25*a* which secures cushioned forend unit 11*a* to element 125*a* is connected into a threaded bore 57*a* in element 125*a* offset forwardly of screw 225*a* and centered axially of the barrel with respect to unit 11*a*. As in the first form of the invention, screw 25*a* acts to exert upward force against the bottom wall 38*a* of reinforcing element 27*a* in unit 11*a* to clamp the upper edges of reinforcing element 27*a* upwardly against the barrel (as in FIG. 3), and thus rigidly hold the reinforcing element 27*a* in fixed position relative to the barrel. The elastomeric material 26*a* of the forend assembly 11*a* presents outer surfaces deformable when contacted by a user's hand or a supporting or locating element to attain the cushioning effect discussed in connection with the first form of the invention. Engagement of vertical end faces 36*a* and 136*a* on parts 125*a* and 26*a* effectively transmits recoil forces between these elements, and engagement of side surfaces on part 125*a* with the side walls of recess 32*a* in body 26*a*** locates the two parts against relative lateral movement.

While certain specific embodiments of the present invention have been disclosed as typical, the invention is of course not limited to these particular forms, but rather is applicable broadly to all such variations as fall within the scope of the appended claims.

We claim:

1. A gun comprising:

a frame;

a barrel projecting forwardly from said frame;

firing mechanism including a trigger;

a cushioned forend part at the underside of said barrel, forwardly of said trigger, including a body of elastomeric material having outer surfaces deformable to cushion a user's contact therewith, and including reinforcing material stiffer than said elastomeric material and embedded therein for handling of the elastomeric material and reinforcing material together as a unit prior to and during attachment to the remainder of the gun; and means securing said forend part in position at the underside of the barrel;

said securing means including a fastener;

said reinforcing material being clamped essentially between said fastener and said barrel.

2. A gun comprising;

a frame;

a barrel projecting forwardly from said frame;

firing mechanism including a trigger;

a cushioned forend part at the underside of said barrel, forwardly of said trigger, including a body of elastomeric material having outer surfaces deformable to cushion a user's contact therewith, and including reinforcing material stiffer than said elastomeric material embedded therein; and means securing said forend part in position at the underside of the barrel;

said securing means including a fastener;

said reinforcing material being of generally U-shaped vertical section and having a bottom portion urged upwardly by said fastener and two side portions projecting upwardly from the bottom portion toward said barrel and applying upward force to the barrel.

3. A gun comprising:

a frame;

a barrel projecting forwardly from said frame;

firing mechanism including a trigger;

a cushioned forend part at the underside of said barrel, forwardly of said trigger, including a body of elastomeric material having outer surfaces deformable to cushion a user's contact therewith, and including reinforcing material stiffer than said elastomeric material embedded therein; and means securing said forend part in position at the underside of the barrel;

said elastomeric body having an upper surface contacting the underside of said barrel, and containing a recess extending downwardly into the elastomeric material beneath the underside of the barrel;

said reinforcing material having a lower portion extending across the bottom of said recess and having two upwardly projecting side portions at opposite sides of said recess extending upwardly toward the barrel.

4. A gun comprising:

a frame;

a barrel projecting forwardly from said frame;

firing mechanism including a trigger;

a cushioned forend part at the underside of said barrel, forwardly of said trigger, including a body of elastomeric material having outer surfaces deformable to cushion a user's contact therewith, and including reinforcing material stiffer than said elastomeric material embedded therein; and means securing said forend part in position at the underside of the barrel;

said reinforcing material including an element of generally U-shaped vertical cross-section beneath the barrel having a bottom wall urged upwardly toward the barrel by said securing means and having two spaced side walls projecting upwardly toward the barrel and applying upward force thereto;

said side walls having rear portions spaced laterally apart a distance greater than forward portions of said side walls and received at opposite sides of said frame and embedded in and cushioned by rear portions of said elastomeric body.

5. A gun comprising:

a frame;

a barrel projecting forwardly from said frame;

firing mechanism including a trigger;

a cushioned forend part at the underside of said barrel, forwardly of said trigger, including a body of elastomeric material having outer surfaces deformable to cushion a user's contact therewith, and including reinforcing material stiffer than said elastomeric material embedded therein; and means securing said forend part in position at the underside of the barrel;

said elastomeric body having an upper essentially partial cylindrical surface engaging and conforming essentially in shape to the underside of said barrel;

said forend part containing a recess extending downwardly beneath the level of said partial cylindrical surface;

said reinforcing material including an element of generally U-shaped vertical section having a bottom wall extending across the bottom of said recess and having side walls projecting upwardly at opposite sides of said recess and applying upward force to said barrel;

said securing means including a fastener acting upwardly against said bottom wall;

said side walls having rear portions spaced laterally apart a distance greater than forward portions of said side walls and received at opposite sides of said frame;

said elastomeric body having rear portions containing said rear portions of said side walls of the reinforcing element and received at opposite sides of said frame.

6. A gun as recited in claim 5, in which said securing means include a member contained within said recess at the underside of said barrel and having an upper surface clamped upwardly against the barrel, said first mentioned fastener extending upwardly through said bottom wall of said U-shaped reinforcing element and exerting force upwardly thereagainst and being threadedly connected to said member, there being at least one additional fastener extending upwardly through said member and means carried by said barrel at the underside thereof and to which said additional fastener is threadedly connectible.

7. For use with a gun having a frame, and having a barrel projecting forwardly from the frame, and firing mechanism including a trigger: a cushioned forend part comprising:

a body of elastomeric material adapted to be secured in a position at the underside of the barrel and forwardly of said trigger and having outer surfaces deformable to cushion a user's contact therewith; and reinforcing material stiffer than said elastomeric material and embedded therein and carried thereby for handling of the elastomeric material and reinforcing material together as a unit prior to and during attachment to the remainder of the gun;

said reinforcing material being constructed to be clamped essentially between a fastener and said barrel.

8. For use with a gun having a frame, and having a barrel projecting forwardly from the frame, and firing mechanism including a trigger: a cushioned forend part comprising:

a body of elastomeric material adapted to be secured in a position at the underside of the barrel and forwardly of said trigger and having outer surfaces deformable to cushion a user's contact therewith; and reinforcing material stiffer than said elastomeric material and embedded therein;

said reinforcing material being of generally U-shaped vertical section having a bottom portion adapted to be urged upwardly by a fastener and two side portions projecting upwardly from the bottom portion toward said barrel.

9. For use with a gun having a frame, and having a barrel projecting forwardly from the frame, and firing mechanism including a trigger: a cushioned forend part comprising:

a body of elastomeric material adapted to be secured in a position at the underside of the barrel and forwardly of said trigger and having outer surfaces deformable to cushion a user's contact therewith; and reinforcing material stiffer than said elastomeric material and embedded therein;

said elastomeric body having an upper surface for contacting the underside of said barrel, and containing a recess extending downwardly into the elastomeric material beneath said upper barrel contacting surface;

said reinforcing material having a lower portion extending across the bottom of said recess and having two upwardly projecting side portions at opposite sides of said recess extending upwardly toward the barrel.

10. For use with a gun having a frame, and having a barrel projecting forwardly from the frame, and firing mechanism including a trigger: a cushioned forend part comprising:

a body of elastomeric material adapted to be secured in a position at the underside of the barrel and forwardly of said trigger and having outer surfaces deformable to cushion a user's contact therewith; and reinforcing material stiffer than said elastomeric material and embedded therein;

said reinforcing material including an element of generally U-shaped vertical cross-section to be received beneath the barrel and having a bottom wall adapted to be urged upwardly toward the barrel by a fastener and two spaced side walls projecting upwardly toward the barrel for applying upward force thereto;

said side walls having rear portions spaced laterally apart a distance greater than forward portions of said side walls and adapted to be received at opposite sides of said frame and embedded in and cushioned by rear portions of said elastomeric body.

11. For use with a gun having a frame, and having a barrel projecting forwardly from the frame, and firing mechanism including a trigger: a cushioned forend part comprising:

a body of elastomeric material adapted to be secured in a position at the underside of the barrel and forwardly of said trigger and having outer surfaces deformable to cushion a user's contact therewith; and reinforcing material stiffer than said elastomeric material and embedded therein;

said elastomeric body having an upper essentially partial cylindrical surface for engaging and conforming essentially to the underside of said barrel;

said forend part containing a recess extending downwardly beneath the level of said partial cylindrical surface;

said reinforcing material including an element of generally U-shaped vertical section having a bottom wall extending across the bottom of said recess and containing an opening for passing a fastener upwardly to exert upward force against said bottom wall;

said element having side walls projecting upwardly at opposite sides of said recess and adapted to apply upward force to the barrel;

said side walls having rear portions spaced farther apart than are forward portions of said side walls and adapted to be received at opposite sides of said frame;

said elastomeric body having rear portions containing said rear portions of said side walls of the reinforcing element and adapted to be received at opposite sides of said frame.

12. A forend part as recited in claim 11, in combination with a member to be received within said recess at the underside of said barrel and having an upper surface which is adapted to be clamped upwardly against the barrel and contains a groove receiving and embracing a portion of the barrel in locating relation, at least one fastener adapted to extend upwardly through said opening in the bottom wall of the U-shaped reinforcing element and exert force upwardly thereagainst and threadedly connectible to said member, and at least one additional fastener adapted to extend upwardly through said member and threadedly connectible to a structure carried by the barrel.

* * * * *